US006448714B1

(12) United States Patent
Akutsu

(10) Patent No.: US 6,448,714 B1
(45) Date of Patent: Sep. 10, 2002

(54) SPARK GAP SWITCH AND SWITCHING METHOD THEREOF

(75) Inventor: Kensuke Akutsu, Toyonaka (JP)

(73) Assignee: Nippon Paint Co., Ltd., Osaka (JP)

( * ) Notice: Subject to any disclaimer, the term of this patent is extended or adjusted under 35 U.S.C. 154(b) by 0 days.

(21) Appl. No.: 09/452,865

(22) Filed: Dec. 2, 1999

(30) Foreign Application Priority Data

Dec. 3, 1998 (JP) ..... 10-344068

(51) Int. Cl.[7] ..... H01J 7/24

(52) U.S. Cl. ..... 315/111.01; 315/108; 315/337; 307/108

(58) Field of Search ..... 315/111.01, 50, 315/112, 108, 117, 110, 150, 326, 358, 335, 337, 209 CD; 307/106, 108; 313/231.01

(56) References Cited

U.S. PATENT DOCUMENTS 4,733,102 A * 3/1988 Nakayama et al. ..... 307/107
4,771,168 A * 9/1988 Gundersen et al. ..... 250/214.1
4,906,576 A * 3/1990 Marshall, III ..... 435/173.6
4,970,433 A * 11/1990 Thayer, III ..... 313/231.01
4,990,831 A * 2/1991 Thayer, III ..... 313/231.01
5,399,910 A * 3/1995 Lamain et al. ..... 307/106
5,587,868 A 12/1996 Akutsu et al. ..... 361/231
6,060,791 A * 5/2000 Goerz et al. ..... 307/110

FOREIGN PATENT DOCUMENTS

EP 0668643 8/1995
JP 7235362 9/1995

* cited by examiner

*Primary Examiner*—Haissa Philogene
(74) *Attorney, Agent, or Firm*—Townsend & Banta

(57) ABSTRACT

In a spark gap switch 12 of a pulse generating circuit 2 of a plasma generator T, an intermediate electrode 15, which is not connected to any electrical source, is disposed at a nearly middle position between a first spherical electrode 13 and a second spherical electrode 15 so as to hold respective spark gaps to the both spherical electrodes 13, 14. Further, in the spark gap switch 12, switching operation is performed between the both spherical electrodes 13, 14 by causing two-stage spark discharge in the first spark gap between the first spherical electrode 13 and the intermediate electrode 15, and in the second spark gap between the intermediate electrode 15 and the second spherical electrode 14. Thus, in the spark gap switch 12, pulse voltage of high voltage and high frequency is stably generated for a long time, and further the spark gap switch 12 may be made compact.

12 Claims, 6 Drawing Sheets

PRIOR ART

SPARK GAP SWITCH AND SWITCHING METHOD THEREOF

BACKGROUND OF THE INVENTION

1. Field of the Invention

The present invention relates to a compact spark gap switch capable of generating pulse voltage of high voltage and high frequency for a long time, in which the pulse width and the peak value are nearly uniform and to a switching method thereof, particularly to the spark gap switch, which is suitable for using as a high voltage pulse generator such as a plasma generator utilizing corona discharge and to the switching method thereof.

2. Description of the Prior Art

Generally, in a plasma generator for generating plasma in air by means of corona discharge, the plasma is generated by applying pulse voltage of high voltage and high frequency between a discharging electrode and an opposite electrode, both of which are disposed to face to each other, so as to cause corona discharge between the both electrodes. Thus, in order to generate the pulse voltage of high voltage and high frequency as described above, generally, there has been used an impulse circuit using a spark gap switch.

In the impulse circuit described above, generally, the pulse voltage of high voltage and high frequency is generated by repeating such processes of providing (charging) electric charge to a charge and discharge capacitor by means of a DC electrical source of high voltage, conducting the circuit by means of the spark gap switch so as to discharge the electric charge of the charge and discharge capacitor, and generating the pulse voltage of a pattern decided in accordance with resistance, inductance and capacitance of the circuit. Hereupon, the spark gap switch, in which a first spherical electrode connected to a unipolar output terminal (positive or negative) of the DC electrical source and a second spherical electrode connected to a positive output terminal are disposed so as to face to each other while holding a predetermined spark gap (interval) therebetween, becomes a conducted state (ON) when the spark discharge is caused between the both spherical electrodes. On the other hand, it becomes an intercepted state (OFF) when the spark discharge is not caused between the both electrodes. Therefore, in the impulse circuit, the frequency of occurrence of the pulse voltage coincides with the frequency of occurrence of the spark discharge in the spark gap switch.

In the spark gap switch described above, the larger the spark gap between the both spherical electrodes which are disposed to face to each other becomes, the higher charging voltage required for causing the spark discharge becomes, in consequence the pulse voltage becomes higher. However, if the spark gap is larger, it becomes harder to satisfy the conditions required for starting the spark discharge. Accordingly, there occurs such a problem that control of the spark discharge becomes more difficult so that the pulse voltage may not be stabilized. On the contrary, if the spark gap is smaller, there may be obtained such an advantage that the control of the spark discharge becomes easier and the frequency of occurrence of the spark discharge increases so that the pulse voltage may be stabilized. However, there may be occur such a problem that the pulse voltage is not raised so much, because the charging voltage required for causing the spark discharge is lowered. That is, in the conventional spark gap switch, there exists such a problem that it is difficult to stabilize the pulse voltage without lowering the pulse voltage.

Further, in the impulse circuit using the spark gap switch described above, there may be caused such a problem that the charging circumstance of the spark gap is deteriorated when the pulse voltage is generated for a long time. That is, if remaining ions, fine metal particles (fine metal chips) and so on stay in the spark gap after a certain spark discharge has been completed, the following spark charge may be started at voltage lower than that of the preceding spark discharge. Accordingly, the resultant pulse voltage may become lower, and further it may become harder to obtain uniform pulse voltage Thus, the applicant (inventor) of the present application has previously proposed a spark gap switch in which the position, where the spark discharge is caused, is fixed (specified) by providing respective protruding portions (protruding electrodes) on the respective positions of the both spherical electrodes, the both positions being disposed so as to face to each other (Japanese Laid-Open Patent Publication No. 7-235362). Further, in the spark gap switch, air is let flow through the spark gap, thereby remaining ions and fine metal particles are prevented from staying there so that the stability (uniformity) and durability of the pulse voltage may be raised.

However, in the above-mentioned conventional spark gap switch according to the applicant of the present application, the following problems are still remained. That is, if the spark gap is enlarged in order to achieve much higher voltage, it is required to delicately (precisely) adjust the length of the spark gap or the dimension of each of the protruding portions (protruding height) or to precisely control the flow rate of the air fed to the spark gap in order to achieve stable pulse voltage. Further, there exists also such a problem that regions of various working conditions, in which the switch can work stably, may become narrower. Accordingly, there may occur such a problem that it is difficult to successively generate the pulse voltage of high voltage and high frequency for a long time.

For example, in order to generate higher voltage pulse, it is required that the length of the spark gap is longer than 150 mm. However, when the spark discharge is caused with the spark gap described above, it is very difficult to adjust the protruding height of each of the protruding portions, the length of the spark gap and the condition for feeding air. Therefore, in order to achieve stable pulse voltage for a long time, delicate adjustment is required and further the working condition, in which the switch can maintain stable working, becomes narrower. Further, because the switch tends to be affected by the temperature, it is indispensable to precisely control the spark gap switch in order to let the switch work stably for a long time. Moreover, there exists also such a problem that the diameter of each of the spherical electrodes and the length of the spark gap are required to be longer in order to achieve the high pulse voltage so that the apparatus becomes large size.

SUMMARY OF THE INVENTION

The present invention, which is achieved to solve the above-mentioned conventional problems, has an object to provide a compact spark gap switch or a switching method thereof, in which pulse voltage of high voltage and high frequency can be generated stably for a long time and further control of spark discharge is easy.

According to the present invention, which has been achieved to solve the above-mentioned problems, there is provided a spark gap switch for performing a switching operation including first and second spherical electrodes disposed so as to hold a space therebetween, between both of which DC voltage is applied, and an intermediate electrode (third electrode) which is disposed at a nearly middle position between the both spherical electrodes in a spherical electrode aligning direction so as to hold respective spark gaps between the respective spherical electrodes and the intermediate electrode. Hereupon, the intermediate electrode is not connected to any electrical source. In the spark gap switch, the switching operation (change of ON/OFF) is performed between the both spherical electrodes by generating respective spark discharges in the spark gap (hereinafter, referred to "first spark gap") between the first spherical electrode and the intermediate electrode and in the spark gap (hereinafter, referred to "second spark gap") between the intermediate electrode and the second spherical electrode.

In the spark gap switch, when high DC voltage (hereinafter, referred to "inter spherical electrode voltage") is applied between the first spherical electrode and the second spherical electrode, there is caused such two-stage spark discharge that at first spark discharge is caused in any one of the first and second spark gaps, and then further spark discharge is caused in the other spark gap. The above-mentioned two-stage spark discharge, is caused with comparatively higher voltage, and further caused by nearly constant inter spherical electrode voltage. Therefore, the pulse voltage, which has nearly uniform output value (output voltage), may be stably generated for a long time. Further, the control of the spark discharge may become extremely easy. Moreover, the spark gap switch may be made compact, because the spark discharge is generated in high voltage and high frequency condition even if the spherical electrodes are comparatively small and the interval between the both spherical electrodes is comparatively short.

In the above-mentioned spark gap switch, it is preferable that the switch further includes a ventilator (for example, of 0–80 m/min flow velocity, or of 0–70 $Nm^3$/min volumetric flow rate) for letting air flow through the space between the both spherical electrodes, in a direction nearly perpendicular to (or crossed with) the spherical electrode aligning direction. Hereupon, the intermediate electrode is preferably disposed at a downstream position in a flowing direction of the air, relative to a straight line linking the centers of the both spherical electrodes to each other. If so, the output value of the pulse voltage may be further made uniform, because remaining ions and fine metal particles do not stay in the space between the both spherical electrodes.

In the above-mentioned spark gap switch, it is also preferable that the intermediate electrode is formed in a spherical shape, a nearly cylindrical shape whose apex end has a hemispherical shape or a nearly flat plate shape whose apex end has a hemicylindrical shape. If so, the output value of the pulse voltage may be made uniform much further. In the spark gap switch, if the intermediate electrode is formed in a spherical shape, it is preferable that the first and second spherical electrodes are provided with respective protruding portions (trigger electrodes) for giving rise to respective spark discharges at such a position of the first spherical electrode that an interval between the first spherical electrode and the intermediate electrode is the shortest and such a position of the second spherical electrode that an interval between the second spherical electrode and the intermediate electrode is the shortest. Hereupon, the intermediate electrode is preferably provided with respective protruding portions (trigger electrodes) for giving rise to the respective spark discharges at such a position thereof that the interval between the first spherical electrode and the intermediate electrode is the shortest and such another position thereof that the interval between the second spherical electrode and the intermediate electrode is the shortest. If so, because the spark discharge is caused between the protruding portions which are disposed to face to each other, the positions, where the spark discharges are caused, are made constant so that the output value of the pulse voltage is made uniform much more. Hereupon, the protruding height of each of the protruding portions may be set to, for example, $1/100$–$1/8$ of the diameter of the corresponding spherical electrode. Further, the outer diameter (width) of each of the protruding portions may be set to, for example, $1/100$–$1/8$ of the diameter of the corresponding spherical electrode.

According to the present invention, there is also provided a switching method of a spark gap switch for performing a switching operation between a first spherical electrode and a second spherical electrode by means of spark discharge, by applying DC voltage between the both spherical electrodes, the both spherical electrodes being disposed so as to hold a space therebetween. Hereupon the switching method includes the step of disposing an intermediate electrode, which is not connected to any electrical source, at a nearly middle position between the both spherical electrodes in a spherical electrode aligning direction so as to hold respective spark gaps between the respective spherical electrodes and the intermediate electrode. Further, the switching method includes the step of generating respective spark discharges in the spark gap (first spark gap) between the first spherical electrode and the intermediate electrode and in the spark gap (second spark gap) between the intermediate electrode and the second spherical electrode so as to perform the switching operation between the both spherical electrodes.

In the switching method of the spark gap switch, when high inter spherical electrode voltage is applied between the first spherical electrode and the second spherical electrode, there is caused such two-stage spark discharge that at first spark discharge is caused in any one of the first and second spark gaps, and then further spark discharge is caused in the other spark gap. The above-mentioned two-stage spark discharge is caused with comparatively higher voltage, and further caused by nearly constant inter spherical electrode voltage. Therefore, the pulse voltage, which has nearly uniform output value (output voltage), may be stably generated for a long time. Further, the control of the spark discharge may become extremely easy. Moreover, the spark gap switch may be made compact, because the spark discharge is generated in high voltage and high frequency condition even if the spherical electrodes are comparatively small and the interval between the both spherical electrodes is comparatively short.

In the above-mentioned switching method of the spark gap switch, it is preferable to let: air flow through the space between the both spherical electrodes, in a direction nearly perpendicular to the spherical electrode aligning direction (for example, with 0–80 m/min flow velocity, or with 0–70 $Nm^3$/min volumetric flow rate). Hereupon, it is preferable to dispose the intermediate electrode at a downstream position in a flowing direction of the air, relative to a straight line linking the centers of the both spherical electrodes to each other. If so, the output value of the pulse voltage may be made uniform further, because remaining ions and fine metal particles do not stay in the space between the both spherical electrodes.

In the above-mentioned switching method of the spark gap switch, it is also preferable to form the intermediate electrode in a spherical shape, a nearly cylindrical shape whose apex end has a hemispherical shape or a nearly flat plate shape whose apex end has a hemicylindrical shape. If so, the output value of the pulse voltage may be made uniform much further. Hereupon, if the intermediate electrode is formed in a spherical shape, it is preferable to provide the first and second spherical electrodes with respective protruding portions (trigger electrodes) for giving rise to respective spark discharges at such a position of the first spherical electrode that an interval between the first spherical electrode and the intermediate electrode is the shortest and such a position of the second spherical electrode that an interval between the second spherical electrode and the intermediate electrode is the shortest. Further, it is preferable to provide the intermediate electrode with respective protruding portions (trigger electrodes) for giving rise to the respective spark discharges at such a position thereof that the interval between the first spherical electrode and the intermediate electrode is the shortest and such another position thereof that the interval between the second spherical electrode and the intermediate electrode is the shortest. If so, because the spark discharge is caused between the protruding portions which are disposed to face to each other, the positions, where the spark discharges are caused, are made constant so that the output value of the pulse voltage is made uniform much more. Hereupon, the protruding height of each of the protruding portions may be set to, for example, 1/100–1/8 of the diameter of the corresponding spherical electrode. Further, the outer diameter (width) of each of the protruding portions may be set to, for example, 1/100–1/8 of the diameter of the corresponding spherical electrode.

BRIEF DESCRIPTION OF THE DRAWINGS

The present invention will become more fully understood from the detailed description given below and the accompanying drawings, wherein.

DETAILED DESCRIPTION OF THE PREFERRED EMBODIMENTS

Hereinafter, embodiments of the present invention will be concretely described.

Figure 1:
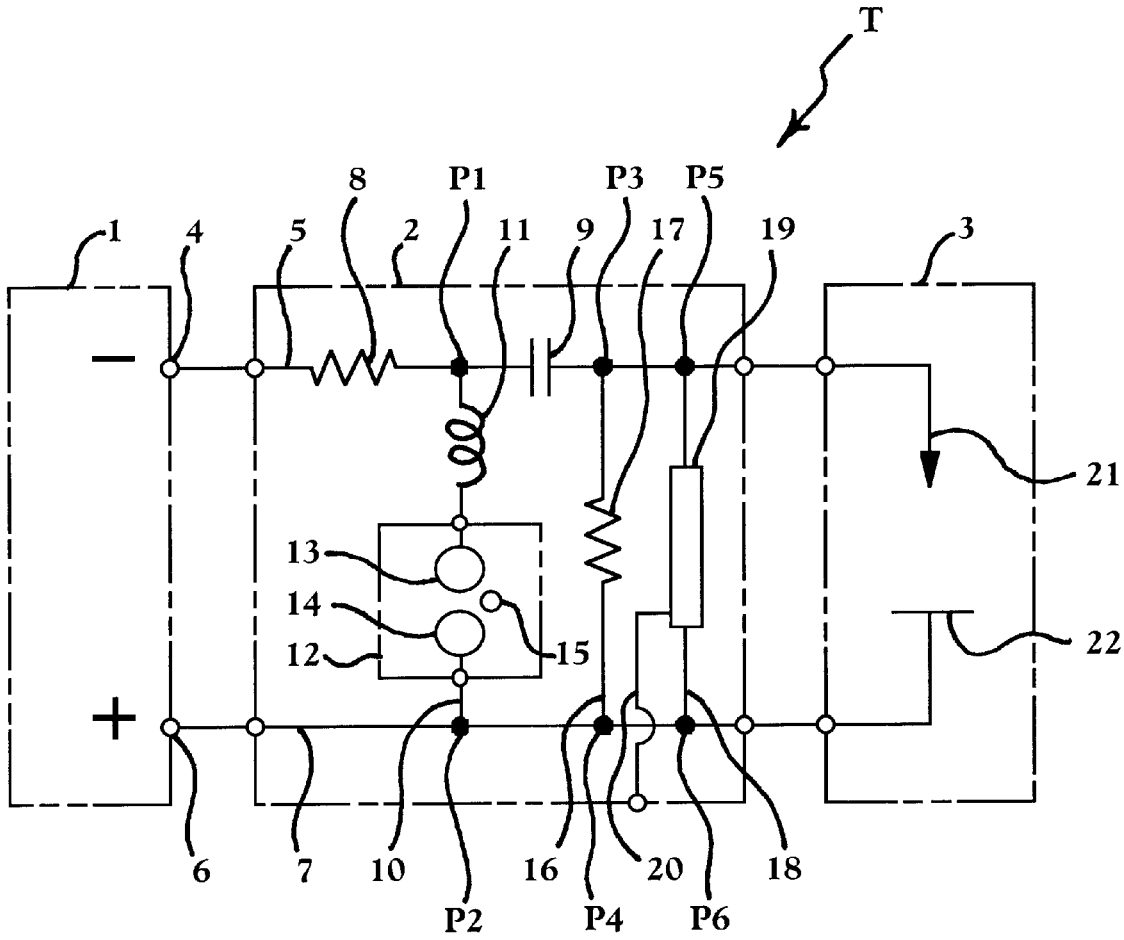
FIG. 1 is a circuit diagram showing a construction of a plasma generator which is provided with a spark gap switch according to the present invention.

As shown in FIG. 1, a plasma generator T according to the present invention is substantially composed of a DC electrical source 1 of high voltage, a pulse generating circuit 2 (impulse circuit) for generating pulse voltage of high voltage and high frequency and a plasma processing portion 3 for generating plasma in air by means of corona discharge. Thus, a first lead 5 (lead wire) of the pulse generating circuit 2 is connected to a negative output terminal 4 of the DC electrical source 1. On the other hand, a second lead 7 (lead wire) of the pulse generating circuit 2 is connected to a positive output terminal 6 of the source.

In the first lead 5 of the pulse generating circuit 2, by turns from the DC electrical source side to the plasma processing portion side, there are interposed a protective resistor 8 and a charge and discharge capacitor 9 in series. Further, the pulse generating circuit 2 is provided with a third lead 10 (lead wire) which connects the point $P_1$ in the first lead 5 to the point $P_2$ in the second lead 7. Thus, in the third lead 10, by turns from the point $P_1$ side to the point $P_2$ side, there are interposed an inductance coil 11 and a spark gap switch 12 in series. Hereupon, as described in detail later, the spark gap switch 12 is provided with a first spherical electrode 13, a second spherical electrode 14 and an intermediate electrode 15 (third electrode).

In the circuit 2, there is also provided a fourth lead 16 (lead wire) which connects the point $P_3$ in the first lead 5 to the point $P_4$ in the second lead 7. In the fourth lead 16, a load resistor 17 is interposed. Further, in the circuit 2, there is provided a fifth lead 18 (lead wire) which connects the point $P_5$ in the first lead 5 to the point $P_6$ in the second lead 7. In the fifth lead 18, a ground portion 19 is interposed. Hereupon, the ground portion 19 is connected to a lead 20 (lead wire) for ground use.

The plasma processing portion 3 is provided with a discharging electrode 21, and an opposite electrode 22 which is disposed so as to face the discharging electrode 21. Thus, the discharging electrode 21 is connected to the first lead 5 (output terminal of pulse voltage) of the pulse generating circuit 2, while the opposite electrode 22 is connected to the second lead 7 (output terminal of pulse voltage) of the pulse generating circuit 2. Hereupon, the discharging electrode 21 and the opposite electrode 22 are disposed so as to hold an adequate interval (for example, 30 cm) therebetween in accordance with the shape and dimension of the processing object (not shown) to which plasma processing is applied.

Thus, the pulse voltage (discharging voltage) of high voltage and high frequency, which is generated by the pulse generating circuit 2 as described later, is applied between the discharging electrode 21 and the opposite electrode 22. In that time, corona discharge is caused in the interval between the discharging electrode 21 and the opposite electrode 22 so that plasma is generated by the corona discharge. When plasma is generated in the interval between the discharging electrode 21 and the opposite electrode 22 as described above, the processing object is let pass through the interval, or disposed in the stationary state therein. In consequence, the surface of the processing object is transformed so that the conditions of the surface (for example, painting property, printing property, adhesive property, moisture-absorbing property, hydrophobic property etc.) are improved. Hereupon, as examples of the processing objects which can be transformed by plasma, there may be cited, for example, a resin molding article, a plastic sheet, a resin film (plastic film), a paper, a cloth, a non-woven cloth, a metal plate or the like.

Hereinafter, the mechanism (process) of causing the pulse voltage of high voltage and high frequency from the output voltage of the DC electrical source 1 in the pulse generating circuit 2 will be described.

That is, the negative electrode (left side in FIG. 1) of the charge and discharge capacitor 9 is connected to the negative output terminal 4 of the DC electrical source 1 through the first lead 5 (including the protective resistor 8), while the positive electrode (right side in FIG. 1) of the charge and discharge capacitor 9 is connected to the positive output terminal 6 of the DC electrical source 1 through the fourth lead 16 (including the load resistor 17) and the second lead 7. Therefore, if the DC electrical source 1 is switched on, the output voltage of the DC electrical source 1 is applied to the charge and discharge capacitor 9 so that electric charge is stored in the capacitor 9.

Meanwhile, the first spherical electrode 13 of the spark gap switch 12 is connected to the negative output terminal 4 of the DC electrical source 1 through the negative portion of the third lead 10 (including the inductance coil 11) and the first lead 5 (including the protective resistor 8), while the second spherical electrode 14 is connected to the positive output terminal 6 of the DC electrical source 1 through the positive portion of the third lead 10 and the second lead 7. Therefore, the voltage applied to the spark gap switch 12 is rapidly raised at the same time that the electric charge is stored in the charge and discharge capacitor 9.

Then, at the nearly same time that the electric charge is stored in the charge and discharge capacitor 9 to be nearly saturated, two-stage spark discharge is caused between the first spherical electrode 13 and the second spherical electrode 14 through (via) the intermediate electrode 15. The two-stage spark discharge will be described later in detail. Thus, the spark gap switch 12 becomes a short circuit state or conducted state (ON) due to the spark discharge. In accordance with that, the electric charge stored in the charge and discharge capacity 9 is discharged nearly in a moment. Thus, the discharged electric charge generates pulse voltage, which has the output voltage decided in accordance with the ratio of the capacitance of the charge and discharge capacitor 9 to the capacitance of the interval between the both electrode 21, 22 of the plasma processing portion 3, and wave shape decided in accordance with the inductance of the inductance coil 11 and the resistance of the load resistor 17. Hereupon, the pulse voltage is generated between the first lead 5 and the second lead 7.

By repeating the above-mentioned processes, the pulse voltage of high voltage and high frequency is applied between the first lead 5 and the second lead 7, that is, between the both electrodes 21, 22 of the plasma processing portion 3. Hereupon, the protective resistor 8 is provided in order to prevent the negative output terminal 4 of the DC electrical source 1 and the positive output terminal 6 from causing short circuit to each other so as to protect the DC electrical source 1 when the spark gap switch 12 becomes the short circuit state or conducted state.

Hereinafter, the concrete construction and function of the spark gap switch 12 will be described with reference to FIG. 2 (front view).

Figure 2:
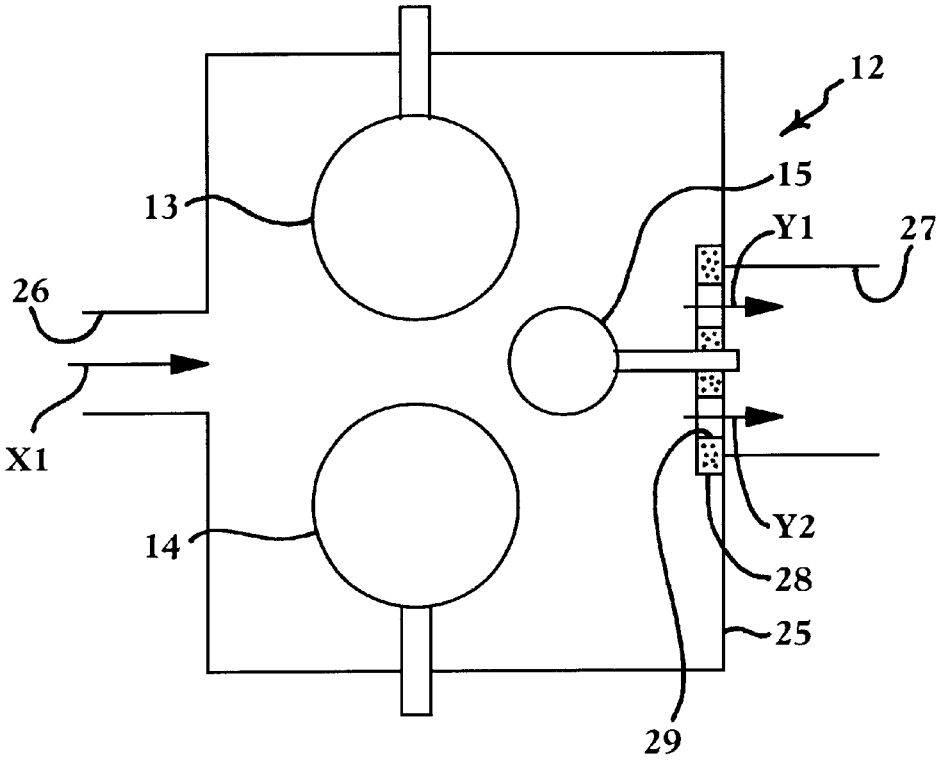
FIG. 2 is a front view of the spark gap switch according to the present invention.

As shown in FIG. 2, the spark gap switch 12 is provided with a switch case 25 (housing) of nearly a hollow rectangular parallelepiped shape, which is made of insulating material (for example, vinyl chloride, acrylic resin, FRP etc.). Hereupon, an air inlet duct 26 opens into the switch case 25 at the middle position of the left side wall of the case. Further, an air outlet duct 27 opens into the switch case 25 at the middle position of the right side wall of the case. Thus, air is fed into the switch case 25 through the air inlet duct 26 as indicated by the arrow $X_1$ by using an air feeder such as a blower (not shown) or the like. The air, which has been fed into the switch case 25 as described above, passes through the switch case 25 nearly toward the right side, and then flows out of the switch case 25 through the air outlet duct 27 as indicated by the arrows $Y_1$,$Y_2$.

Thus, in the switch case 25, the first spherical electrode 13 and the second spherical electrode 14 are disposed so as to stand upward and downward while holding a predetermined interval therebetween. Each of the spherical electrodes 13, 14, which is made of conductive material such as stainless steel or copper base alloy, is formed in a hollow spherical shape. However, each of the spherical electrodes 13, 14 may be formed in a solid state (without hollow portion), not the hollow state described above. Hereupon, the both spherical electrodes 13, 14 are disposed in such a manner that the space between the both spherical electrodes 13, 14 stands at a position corresponding to the air inlet duct 26, namely the air which has been fed from the air inlet duct 26 into the switch case 25, mainly flows through the space between the both spherical electrodes 13, 14. In other words, the air flows through the space between the both spherical electrodes 13, 14 in the direction nearly perpendicular to the spherical electrode aligning direction.

Meanwhile, the intermediate electrode 15 is disposed at such a position that stands at a middle point between the both spherical electrodes 13, 14 in the up and down direction (spherical electrode aligning direction), and stands at a somewhat right point in the left and right direction, relative to the straight line (hereinafter, referred to "spherical electrode center line") linking the centers of the both spherical electrodes 13, 14 in the up and down direction to each other, namely at a somewhat downstream point in the air flowing direction, relative to the spherical electrode center line. Hereupon, the intermediate electrode 15 is also disposed so as to hold respective predetermined spark gaps to the both spherical electrodes 13, 14. The intermediate electrode 15, which is made of conductive material such as stainless steel or copper base alloy and formed in a hollow spherical shape, is not connected to any electrical source, thereby it is in an electrically isolated condition. Hereupon, the intermediate electrode 15 may be formed in a solid state, not the hollow state described above. The intermediate electrode 15 is mounted on the right side wall of the switch case 25 using a fastener 28. Hereupon, the fastener 28 is provided with holes for letting air flow therethrough, because the fastener 28 is disposed at a position where it overlaps the air outlet duct 27.

Thus, in the spark gap switch 12, when the high inter spherical electrode voltage (DC voltage) is applied between the both spherical electrodes 13, 14 by the DC electrical source 1, there is caused such two-stage spark discharge that initially spark discharge is caused in the spark gap (first spark gap) between the first spherical electrode 13 and the intermediate electrode 15, and then further spark discharge is caused in the spark gap (second spark gap) between the intermediate electrode 15 and the second spherical electrode 14. The above-mentioned two-stage spark discharge is caused with comparatively higher voltage, and further caused by nearly constant inter spherical electrode voltage. Therefore, the pulse voltage, whose output value (output voltage) is nearly uniform, may be stably output from the pulse generating circuit 2 for a long time. Further, the control of the spark discharge may become extremely easy. Moreover, because the air always flows through the space between the both spherical electrodes 13, 14, remaining ions, fine metal particles and so on do not stay in the space so that the output value of the pulse voltage may be made uniform more.

Further, in the spark gap switch 12, even if the both spherical electrodes 13, 14 are comparatively small and the interval between the both spherical electrodes 13, 14 is comparatively small, the pulse voltage of high voltage and high frequency, whose output voltage is nearly uniform, may be stably generated for a long time. Therefore, the spark gap switch 12 may be made compact in comparison with the conventional spark gap switch.

Meanwhile, in the above-mentioned embodiment, the intermediate electrode 15 is formed in the spherical shape. However, the shape of the intermediate electrode 15 need not restricted the above.

Figure 3A:
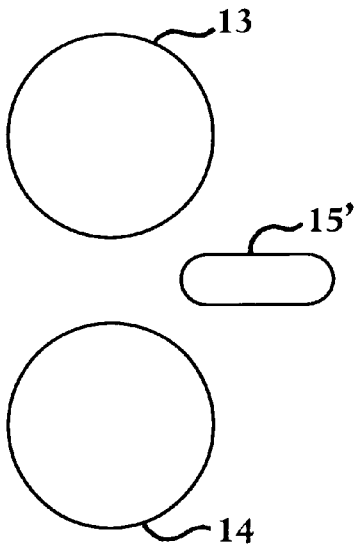
FIG. 3A is a front view of the main portion of a spark gap switch which is provided with an intermediate electrode according to a variation of the present invention.

For example, as shown in FIG. 3A, the intermediate electrode 15' may be formed in a nearly cylindrical shape whose apex end has a hemispherical shape. Alternatively, the intermediate electrode 15' may be also formed in a nearly flat plate shape whose apex end has a hemicylindrical shape, not the above-mentioned nearly cylindrical shape. Hereupon, it is of course that the intermediate electrode 15' may be formed in any one of the hollow state and solid state.

Figure 3B:
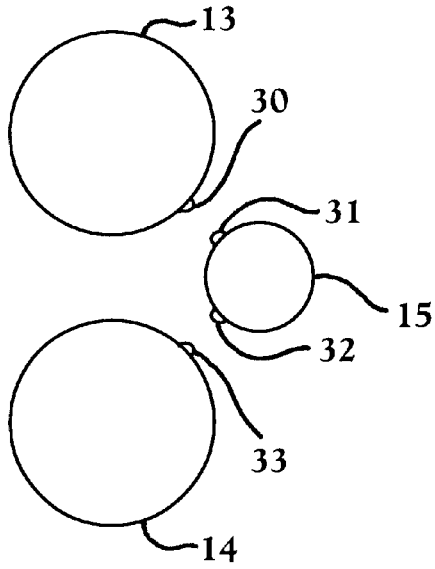
FIG. 3B is a front view of the main portion of a spark gap switch which is provided with an intermediate electrode according to another variation of the present invention.

Meanwhile, as shown in FIG. 3B, if the intermediate electrode 15 is formed in a spherical shape, the first spherical electrode 13 and the intermediate electrode 15 may be provided with respective protruding portions 30, 31 (trigger electrodes) for giving rise to spark discharge in the first spark gap, while the intermediate electrode 15 and the second spherical electrode 14 may be provided with respective protruding portions 32, 33 (trigger electrodes) for giving rise to spark discharge in the second spark gap. In this case, the protruding portions 30, 31 of the first spark gap side are disposed at such respective positions (facing positions) that the interval between the first spherical electrode 13 and the intermediate electrode 15 becomes minimum, while the protruding portions 32, 33 of the second spark gap side are disposed at such respective positions (facing positions) that the interval between the intermediate electrode 15 and the second spherical electrode 14 becomes minimum.

If the above-mentioned protruding portions 30–33 are provided, the spark discharges are caused at fixed or specified respective positions between the protruding portion 30 and the protruding position 31 and between the protruding portion 32 and the protruding position 33. Therefore, the positions, where the spark discharges are caused, are made constant so that the output value of the pulse voltage may be made uniform much more.

Hereinafter, as to a spark gap switch 12 with an intermediate electrode 15 according to the present invention and a conventional spark gap switch 12' without the intermediate electrode 15, their dimensions or shapes and output property of the pulse voltage will be compared to each other.

Figure 4B:
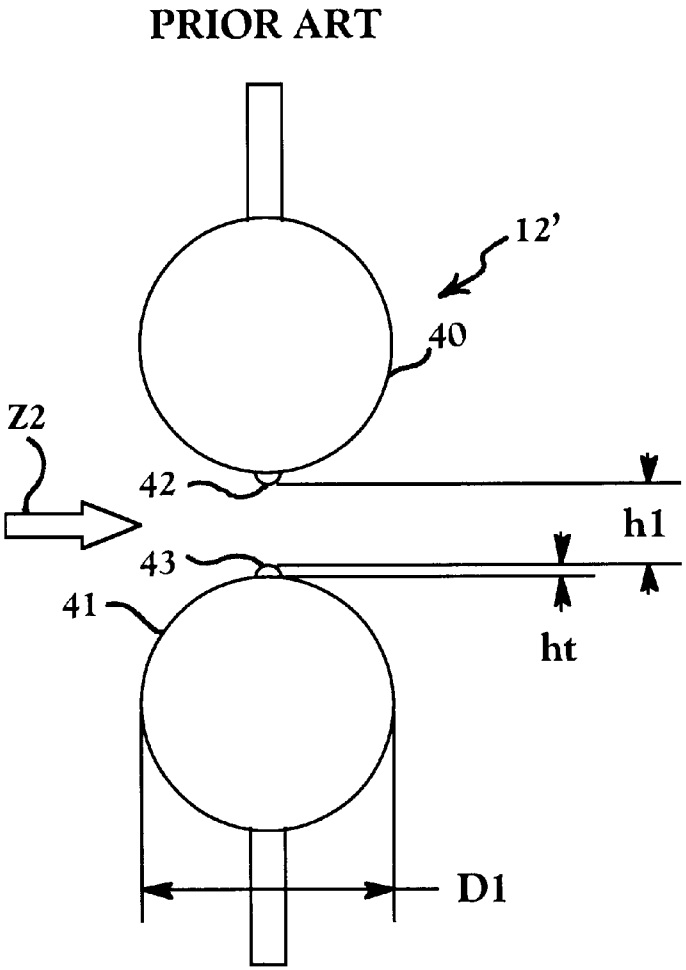
FIG. 4B is a view showing a configuration of each of the electrodes of a conventional spark gap switch.
Figure 4A:
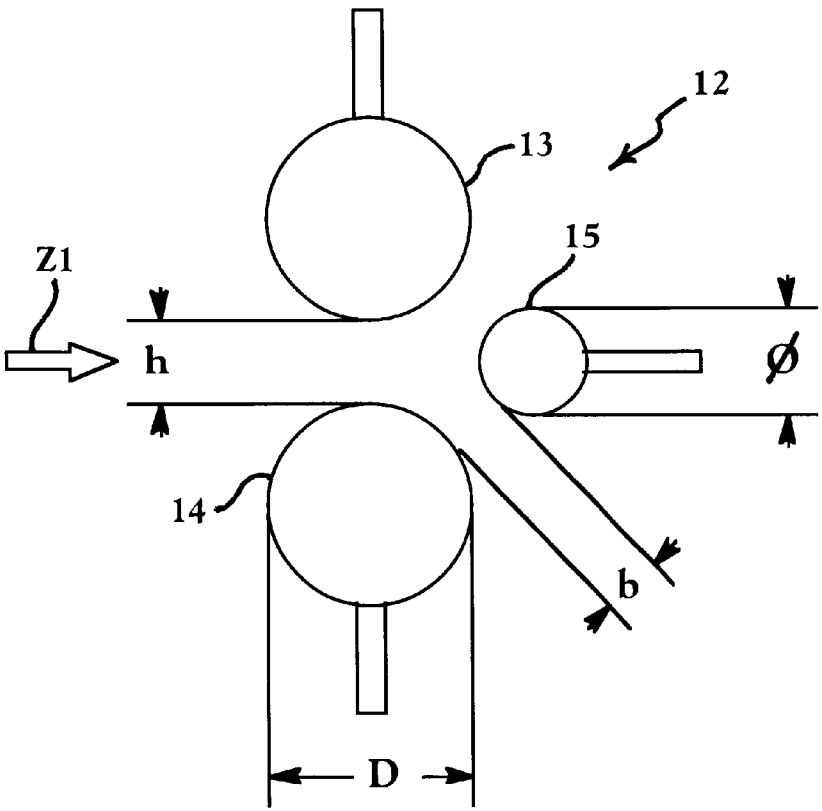
FIG. 4A is a view showing a configuration of each of the electrodes of the spark gap switch according to the present invention.

FIG. 4A shows the spark gap switch 12 according to the present invention, which is provided with the intermediate electrode 15 between the first spherical electrode 13 and the second spherical electrode 14. In FIG. 4A, the arrow $Z_1$ indicates the air flowing direction.

On the other hand, FIG. 4B shows the conventional spark gap switch 12', which is not provided with any intermediate electrode 15, but is provided with respective protruding portions 42,43 for giving rise to spark discharges on a first spherical electrode 40 and a second spherical electrode 41. In FIG. 4B, the arrow $Z_2$ indicates the air flowing direction.

In the case that pulse voltage generated in the pulse generating circuit 2 is set to approximately 230 KV (spark gap switch of comparatively large size), various dimensions of each of the spark gap switch 12 shown in FIG. 4A according to the present invention and the conventional spark gap switch 12' shown in FIG. 4B are as follows.

(Spark gap switch according to the present invention)

(1) Diameter of spherical electrode D: 120 mm (2) Diameter of intermediate electrode ϕ: 80 mm (3) Interval between both electrodes h: 100–120 mm (4) Spark gap b: 40 mm (5) Diameter of air duct: 100 mm (Conventional spark gap switch)

(1) Diameter of spherical electrode $D_1$: 200 mm (2) Height of protruding portion ht: 8–10 mm (3) Interval between protruding portions $h_1$: 170 mm (4) Diameter of air duct: 50 mm In the spark gap switch 12 of comparatively large size according to the present invention which is provided with the intermediate electrode 15 as described above, the diameter D of each of the spherical electrodes and the interval h between the both spherical electrodes are sharply smaller in comparison with those of the conventional spark gap switch 12' (approximately 60%, respectively). Therefore, the spark gap switch 12 may be effectively made compact.

Figure 5:
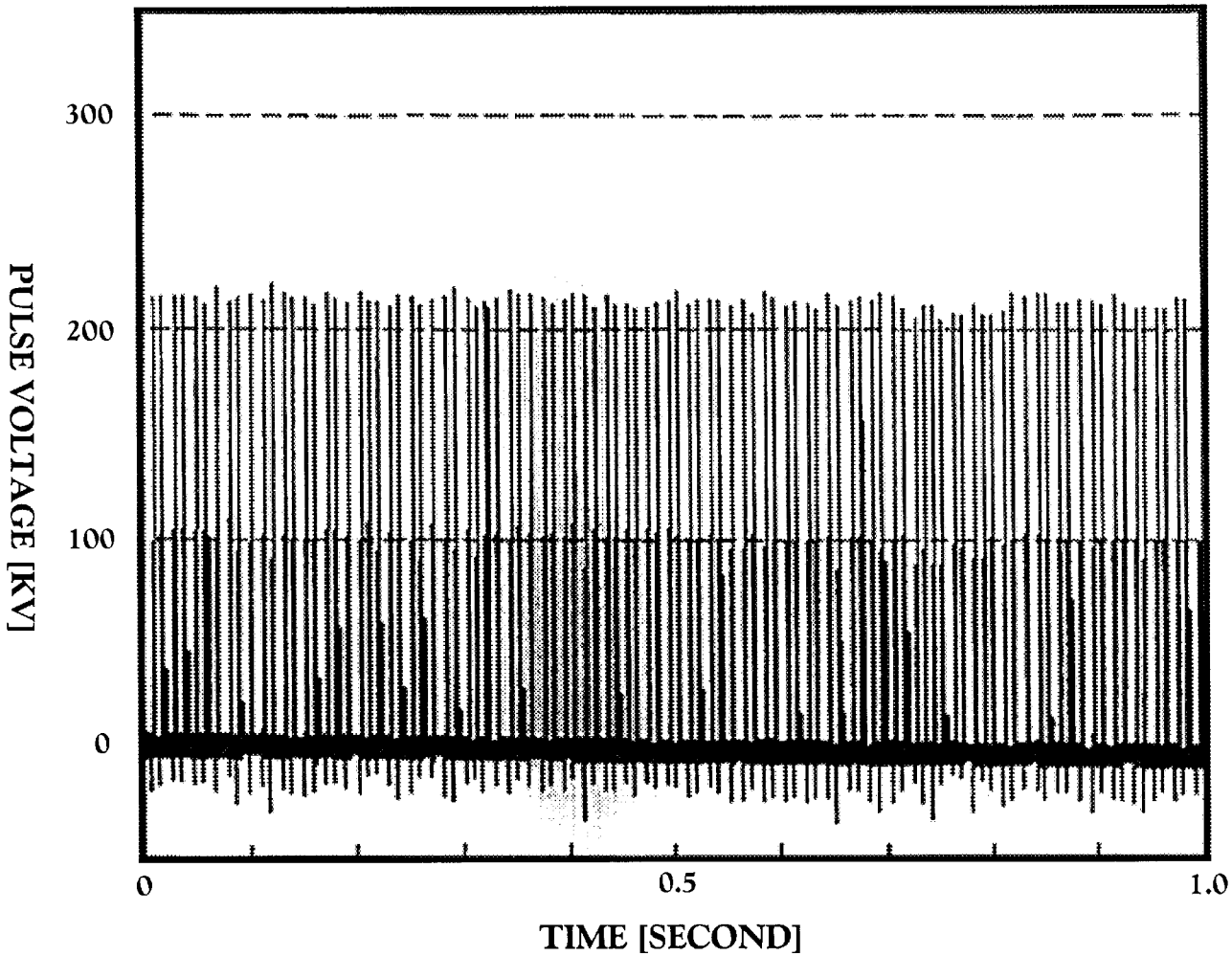
FIG. 5 is a graph showing an example of measured values (data) of the pulse voltage generated by the pulse generating circuit which is provided with the spark gap switch according to the present invention.

FIG. 5 shows an example of the measured values (data) of the pulse voltage generated by the pulse generating circuit 2 using the spark gap switch 12 of comparatively large size according to the present invention, which has the above-mentioned shape.

Figure 6:
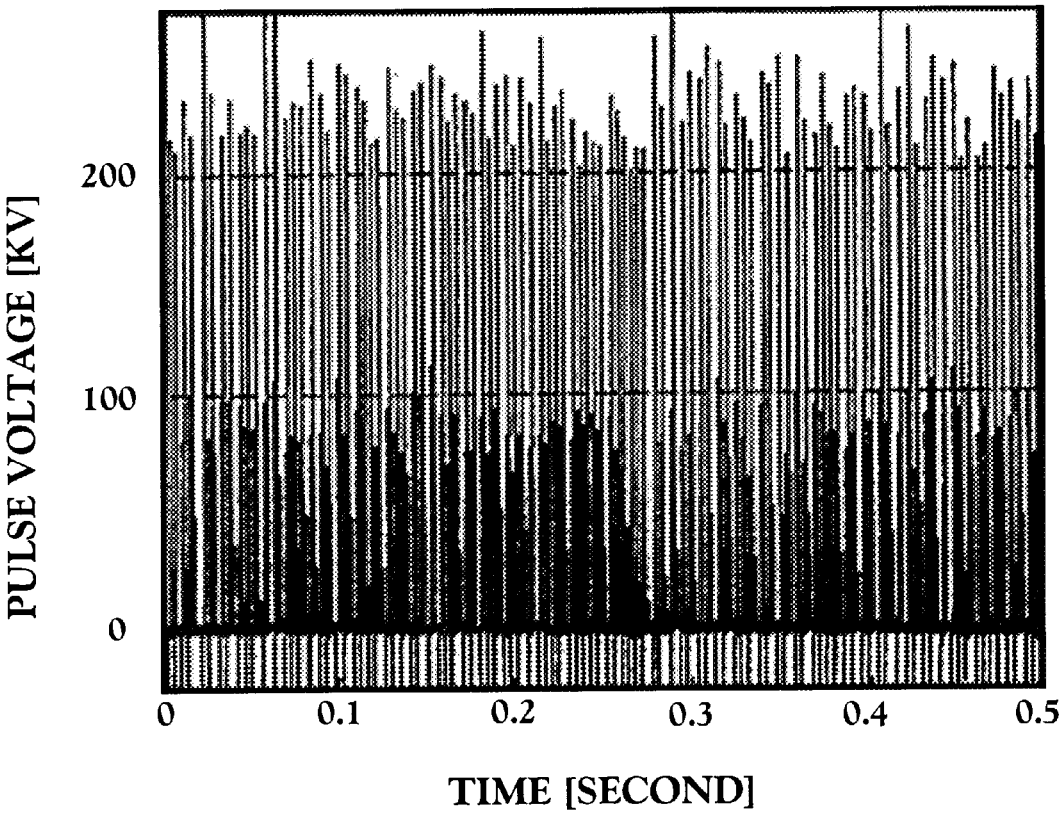
FIG. 6 is a graph showing an example of measured values (data) of the pulse voltage generated by the pulse generating circuit which is provided with the conventional spark gap switch.

Further, FIG. 6 shows an example of the measured values (data) of the pulse voltage generated by the pulse generating circuit 2 using the conventional spark gap switch 12' of comparatively large size, which has the above-mentioned shape.

As apparent from FIGS. 5 and 6, in the spark gap switch 12 of comparatively large size according to the present invention (FIG. 5), the output values of the pulse voltage are made uniform in comparison with those of the conventional spark gap switch 12' (FIG. 6).

Meanwhile, in the case that pulse voltage generated in the pulse generating circuit 2 is set to approximately 70 KV (spark gap switch of comparatively small size), various dimensions of each of the spark gap switch 12 shown in FIG. 4A according to the present invention and the conventional spark gap switch 12' shown in FIG. 4B are as follows.

(Spark Gap Switch according to the present invention)

(1) Diameter of 1spherical electrode D: 80 mm (2) Diameter of intermediate electrode ϕ: 50 mm (3) Interval between both electrodes h: 60 mm (4) Spark gap b: 10 mm (Conventional Spark Gap Switch)

(1) Diameter of spherical electrode $D_1$: 120 mm (2) Height of protruding portion ht: 8 mm (3) Interval between protruding portions $h_1$: 70 mm In the spark gap switch 12 of comparatively small size according to the present invention which is provided with the intermediate electrode 15 as described above, also, the diameter D of each of the spherical electrodes and the interval h between the both spherical electrodes are considerably smaller in comparison with those of the conventional spark gap switch 12'. Therefore, the spark gap switch 12 may be effectively made compact.

Figure 7:
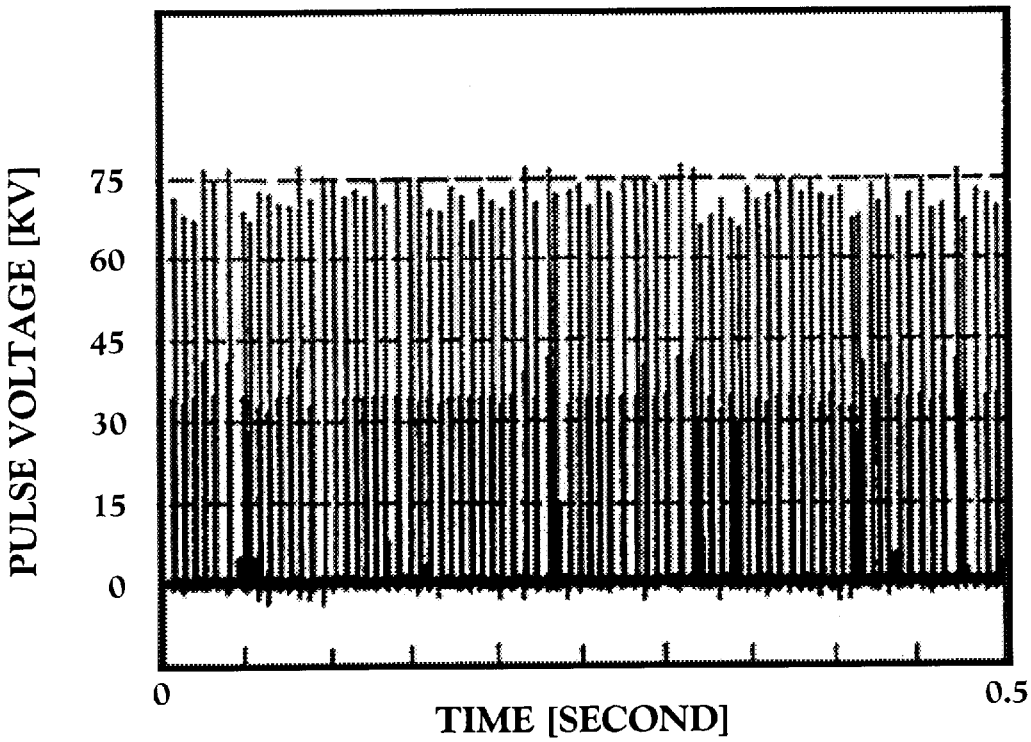
FIG. 7 PRIOR ART
FIG. 7 is a graph showing another example of measured values of the pulse voltage generated by the pulse generating circuit which is provided with the spark gap switch according to the present invention.

FIG. 7 shows an example of the measured values (data) of the pulse voltage generated by the pulse generating circuit 2 using the spark gap switch 12 of comparatively small size according to the present invention, which has the above-mentioned shape.

Figure 8:
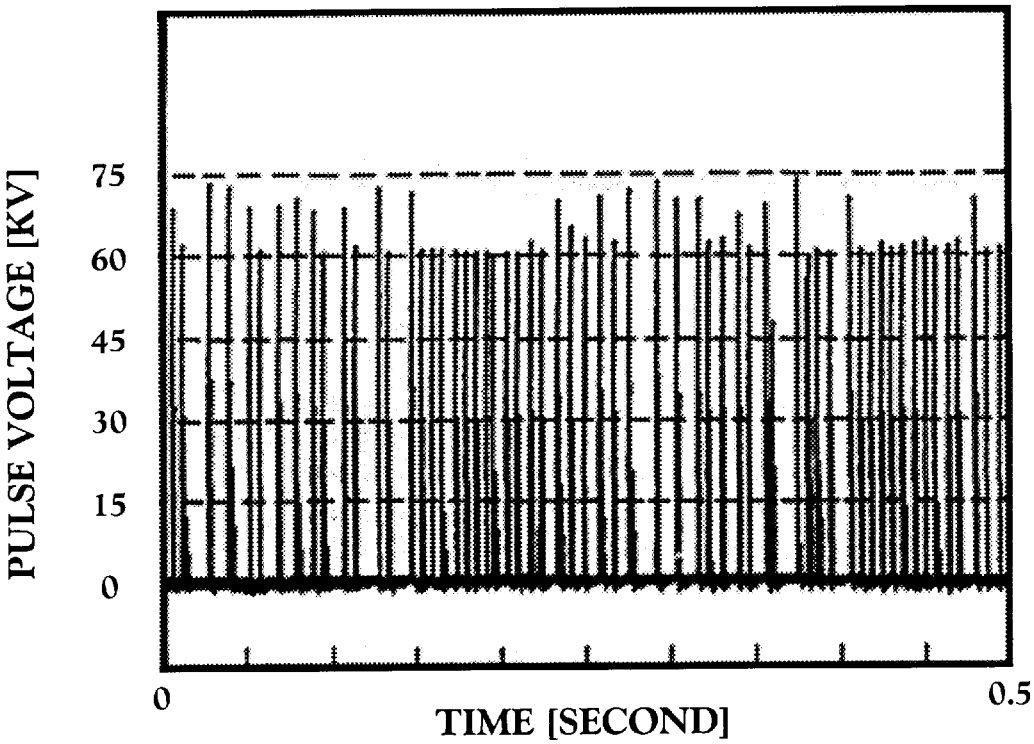
FIG. 8 is a graph showing another example of measured values of the pulse voltage generated by the pulse generating circuit which is provided with the conventional spark gap switch.

Further, FIG. 8 shows an example of the measured values (data) of the pulse voltage generated by the pulse generating circuit 2 using the conventional spark gap switch 12' of comparatively small size, which has the above-mentioned shape.

As apparent from FIGS. 7 and 8, in the spark gap switch 12 of comparatively small size according to the present invention (FIG. 7), also, the output values of the pulse voltage are made uniform in comparison with those of the conventional spark gap switch 12' (FIG. 8).

Although the present invention has been described in relation to particular embodiments thereof, many other variations and modifications will become apparent to those skilled in the art. It is preferred, therefore, that the present invention be limited not by the specific disclosure herein, but only by the appended claims.

What is claimed is:

1. A spark gap switch for performing a switching operation comprising:

first and second spherical electrodes disposed so as to hold a space therebetween, between both of which DC voltage is applied; and an intermediate electrode which is disposed at a nearly middle position between the both spherical electrodes in a spherical electrode aligning direction so as to hold respective spark gaps between the respective spherical electrodes and the intermediate electrode, the intermediate electrode not being connected to any electrical source, wherein the switching operation is performed between the both spherical electrodes by generating respective spark discharges in the spark gap between the first spherical electrode and the intermediate electrode and in the spark gap between the intermediate electrode and the second spherical electrode, a ventilator for letting air flow through the space between the both spherical electrodes, in a direction nearly perpendicular to the spherical electrode aligning direction, wherein the intermediate electrode is disposed at a downstream position in a flowing direction of the air, relative to a straight line linking the centers of the both spherical electrodes to each other.

2. The spark gap switch claim 1, wherein the intermediate electrode is formed in a spherical shape.

3. The spark gap switch according to claim 2, wherein the first and second spherical electrodes are provided with respective protruding portions for giving rise to respective spark discharges at such a position of the first spherical electrode that an interval between the first spherical electrode and the intermediate electrode is the shortest and such a position of the second spherical electrode that an interval between the second spherical electrode and the intermediate electrode is the shortest, while the intermediate electrode is provided with respective protruding portions for giving rise to the respective spark discharges at such a position thereof that the interval between the first spherical electrode and the intermediate electrode is the shortest and such another position thereof that the interval between the second spherical electrode and the intermediate electrode is the shortest.

4. The spark gap switch according to claim 1, wherein the intermediate electrode is formed in a nearly cylindrical shape, of which apex end has a hemispherical shape.

5. The spark gap switch according to claim 1, wherein the intermediate electrode is formed in a nearly flat plate shape, of which apex end has a hemicylindrical shape.

6. A spark-gap switch for performing a switching operation comprising:

first and second spherical electrodes disposed so as to hold a space therebetween, between both of which DC voltage is applied; and an intermediate electrode which is disposed at a nearly middle position between the both spherical electrodes in a spherical electrode aligning direction so as to hold respective spark gaps between the respective spherical electrodes and the intermediate electrode, the intermediate electrode not being connected to any electrical source, wherein the switching operation is performed between the both spherical electrodes by generating respective spark discharges in the spark gap between the first spherical electrode and the intermediate electrode and in the spark gap between the intermediate electrode and the second spherical electrode, wherein the intermediate electrode is formed in a spherical shape, wherein the first and second spherical electrodes are provided with respective protruding portions for giving rise to respective spark discharges at such a position of the first spherical electrode that an interval between the first spherical electrode and the intermediate electrode is the shortest and such a position of the second spherical electrode that an interval between the second spherical electrode and the intermediate electrode is the shortest, while the intermediate electrode is provided with respective protruding portions for giving rise to the respective spark discharges at such a position thereof that the interval between the first spherical electrode and the intermediate electrode is the shortest and such another position thereof that the interval between the second spherical electrode and the intermediate electrode is the shortest.

7. A switching method of a spark gap switch for performing a switching operation between a first spherical electrode and a second spherical electrode by means of spark discharge, by applying DC voltage between the both spherical electrodes, the both spherical electrodes being arrayed so as to hold a space therebetween, the method comprising the steps of:

disposing an intermediate electrode, which is not connected to any electrical source, at a nearly middle position between the both spherical electrodes in a spherical electrode aligning direction so as to hold respective spark gaps between the respective spherical electrodes and the intermediate electrode; and generating respective spark discharges in the spark gap between the first spherical electrode and the intermediate electrode and in the spark gap between the intermediate electrode and the second spherical electrode so as to perform the switching operation between the both spherical electrodes, wherein the intermediate electrode is formed in a spherical shape, wherein the first and second spherical electrodes are provided with respective protruding portions for giving rise to respective spark discharges at such a position of the first spherical electrode that, an interval between the first spherical electrode and the intermediate electrode is the shortest and such a position of the second spherical electrode that an interval between the second spherical electrode and the intermediate electrode is the shortest, while the intermediate electrode is provided with respective protruding portions for giving rise to the respective spark discharges at such a position thereof that the interval between the first spherical electrode and the intermediate electrode is the shortest and such another position thereof that the interval between the second spherical electrode and the intermediate electrode is the shortest.

8. A switching method of a spark gap switch for performing a switching operation between a first spherical electrode and a second spherical electrode by means of spark discharge, by applying DC voltage between the both spherical electrodes, the both spherical electrodes being arrayed so as to hold a space therebetween, the method comprising the steps of:

disposing an intermediate electrode, which is not connected to any electrical source, at a nearly middle position between the both spherical electrodes in a spherical electrode aligning direction so as to hold respective spark gaps between the respective spherical electrodes and the intermediate electrode; and generating respective spark discharges in the spark gap between the first spherical electrode and the intermediate electrode and in the spark gap between the intermediate electrode and the second spherical electrode so as to perform the switching operation between the both spherical electrodes, wherein air is let flow through the space between the both spherical electrodes in a direction nearly perpendicular to the spherical electrode aligning direction in such a manner that the intermediate electrode exists at a downstream position in a flowing direction of the air, relative to a straight line linking the centers of the both spherical electrodes to each other.

9. The switching method of the spark gap switch according to claim 8, wherein the intermediate electrode is formed in a spherical shape.

10. The switching method of the spark gap switch according to claim 9, wherein the first and second spherical electrodes are provided with respective protruding portions for giving rise to respective spark discharges at such a position of the first spherical electrode that an interval between the first spherical electrode and the intermediate electrode is the shortest and such a position of the second spherical electrode that an interval between the second spherical electrode and the intermediate electrode is the shortest, while the intermediate electrode is provided with respective protruding portions for giving rise to the respective spark discharges at such a position thereof that the interval between the first spherical electrode and the intermediate electrode is the shortest and such another position thereof that the interval between the second spherical electrode and the intermediate electrode is the shortest.

11. The switching method of the spark gap switch according to claim 8, wherein the intermediate electrode is formed in a nearly cylindrical shape, of which apex end has a hemispherical shape.

12. The switching method of the spark gap switch according to claim 8, wherein the intermediate electrode is formed in a nearly flat plate shape, of which apex end has a hemicylindrical shape.

* * * * *